US009114302B2

(12) United States Patent
Mendelsohn

(10) Patent No.: US 9,114,302 B2
(45) Date of Patent: Aug. 25, 2015

(54) GOLF SWING TRAINING DEVICE AND A METHOD FOR USING THE SAME

(71) Applicant: Mark Philip Mendelsohn, San Diego, CA (US)

(72) Inventor: Mark Philip Mendelsohn, San Diego, CA (US)

( * ) Notice: Subject to any disclaimer, the term of this patent is extended or adjusted under 35 U.S.C. 154(b) by 70 days.

(21) Appl. No.: 14/057,885

(22) Filed: Oct. 18, 2013

(65) Prior Publication Data

US 2015/0111656 A1 Apr. 23, 2015

(51) Int. Cl.

| | |
|---|---|
| ***A63B 69/36*** | (2006.01) |
| ***A63B 71/06*** | (2006.01) |
| ***A63B 24/00*** | (2006.01) |

(52) U.S. Cl.

CPC ..... *A63B 69/3614* (2013.01); *A63B 24/0003* (2013.01); *A63B 71/0622* (2013.01); *A63B 24/0006* (2013.01); *A63B 2071/0627* (2013.01); *A63B 2071/0694* (2013.01); *A63B 2207/02* (2013.01); *A63B 2208/0204* (2013.01); *A63B 2220/805* (2013.01); *A63B 2225/093* (2013.01); *A63B 2225/50* (2013.01)

(58) Field of Classification Search

USPC ..... 473/131, 150, 151, 156, 219–225, 257, 473/261, 264, 265, 266, 409

See application file for complete search history.

(56) References Cited

U.S. PATENT DOCUMENTS

| | | | | |
|---|---|---|---|---|
| 3,776,555 | A * | 12/1973 | Hagaman | 473/221 |
| 3,801,108 | A * | 4/1974 | Murray | 473/225 |
| 4,903,968 | A * | 2/1990 | Hargrave | 473/220 |
| 5,087,047 | A * | 2/1992 | McConnell | 473/221 |
| 8,177,654 | B2 * | 5/2012 | Pelz | 473/220 |
| 2005/0239568 | A1 * | 10/2005 | Stringer | 473/270 |
| 2011/0159980 | A1 * | 6/2011 | Pelz | 473/220 |

* cited by examiner

*Primary Examiner* — Nini Legesse

(57) ABSTRACT

A golf swing training device communicates a deviation from a proper golf swing path. The golf swing training device includes a two stands each having a stand adjustment scale attached to a light detector, a light source and a stand base. An upper beam is created by aligning the upper light detector with the upper light source. A lower beam is created by aligning the lower light detector with the lower light source. The proper golf swing path involves swinging a golf club on a back swing outside the lower beam and inside the upper beam, on a down swing inside the upper beam and outside the lower beam and on the follow through, outside the lower beam and inside the upper beam. The deviation from the proper golf swing path is communicated to a user.

7 Claims, 4 Drawing Sheets

GOLF SWING TRAINING DEVICE AND A METHOD FOR USING THE SAME

BACKGROUND

The embodiments herein relate generally to sports equipment.

Prior to embodiments of the disclosed invention, mechanical golf swing trainers were big, bulky, heavy and were not portable. Many required bolting something to the club or physically engaging the club into an apparatus. This required a lot of setup time as each different club was used. Swinging at full speed could be dangerous if the mechanics of the apparatus would jam. Many of these prior art devices did not allow hitting a golf ball. Embodiments of the disclosed invention solve this problem.

SUMMARY

A golf swing training device is configured to communicate a deviation from a proper golf swing path. The golf swing training device includes a rear stand having a rear stand adjustment scale attached to an upper light detector, a lower light source and a rear stand base. A front stand having a front stand adjustment scale attached to a lower light detector, an upper light source and a front stand base. An upper beam is created by aligning the upper light detector with the upper light source. A lower beam is created by aligning the lower light detector with the lower light source. The proper golf swing path involves swinging a golf club on a back swing outside the lower beam and inside the upper beam, on a down swing inside the upper beam and outside the lower beam and on the follow through, outside the lower beam and inside the upper beam. The deviation from the proper golf swing path is communicated to a user.

A process for using a golf swing training device in order to communicate a deviation from a proper golf swing path has the following steps, not necessarily in order. First, positioning a front stand proximate a rear stand. The front stand further comprises a front stand adjustment scale attached to a lower light detector, an upper light source and a front stand base. The rear stand further comprises a rear stand adjustment scale attached to an upper light detector, a lower light source and a rear stand base. Next, spacing the front stand and the rear stand a distance from one another greater than a golf swing path. Then, expanding the rear stand base to ensure the rear stand is perpendicular to ground. Similarly, expanding the front stand base to ensure the front stand is perpendicular to the ground. After that, measuring an inseam of a user. Next, adjusting the upper light detector along the rear stand adjustment scale to the inseam of the user. Then, adjusting the upper light source along the front stand adjustment scale to the inseam of the user. After that adjusting the lower light source to be approximately 10 inches beneath the upper light detector. Similarly, adjusting the lower light detector to be approximately 10 inches beneath the upper light source.

Next, creating an upper beam by aligning the upper light detector with the upper light source. Then, creating a lower beam by aligning the lower light detector with the lower light source. After that, locating a ball between the front stand and the rear stand. Next, swinging a golf club in the golf swing path. The proper golf swing path involves swinging a golf club on a back swing outside the lower beam and inside the upper beam, on a down swing inside the upper beam and outside the lower beam and on the follow through, outside the lower beam and inside the upper beam. Finally, communicating the deviation of the proper golf swing path.

In some embodiments, the rear stand adjustment scale and the front stand adjustment scale both contain a series of spaced measurements that measure distance upward from ground. In some embodiments, the deviation from the proper golf swing path is communicated by having the lower light detector produce a low tone and having the upper light detector will produce a high tone. In some embodiments, the deviation from the proper golf swing path is communicated by an upper wireless transmitter communicatively coupled to the upper light detector and a lower wireless transmitter communicatively coupled to the lower light detector. The upper wireless transmitter and the lower wireless transmitter are communicatively coupled to a swing analysis application.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
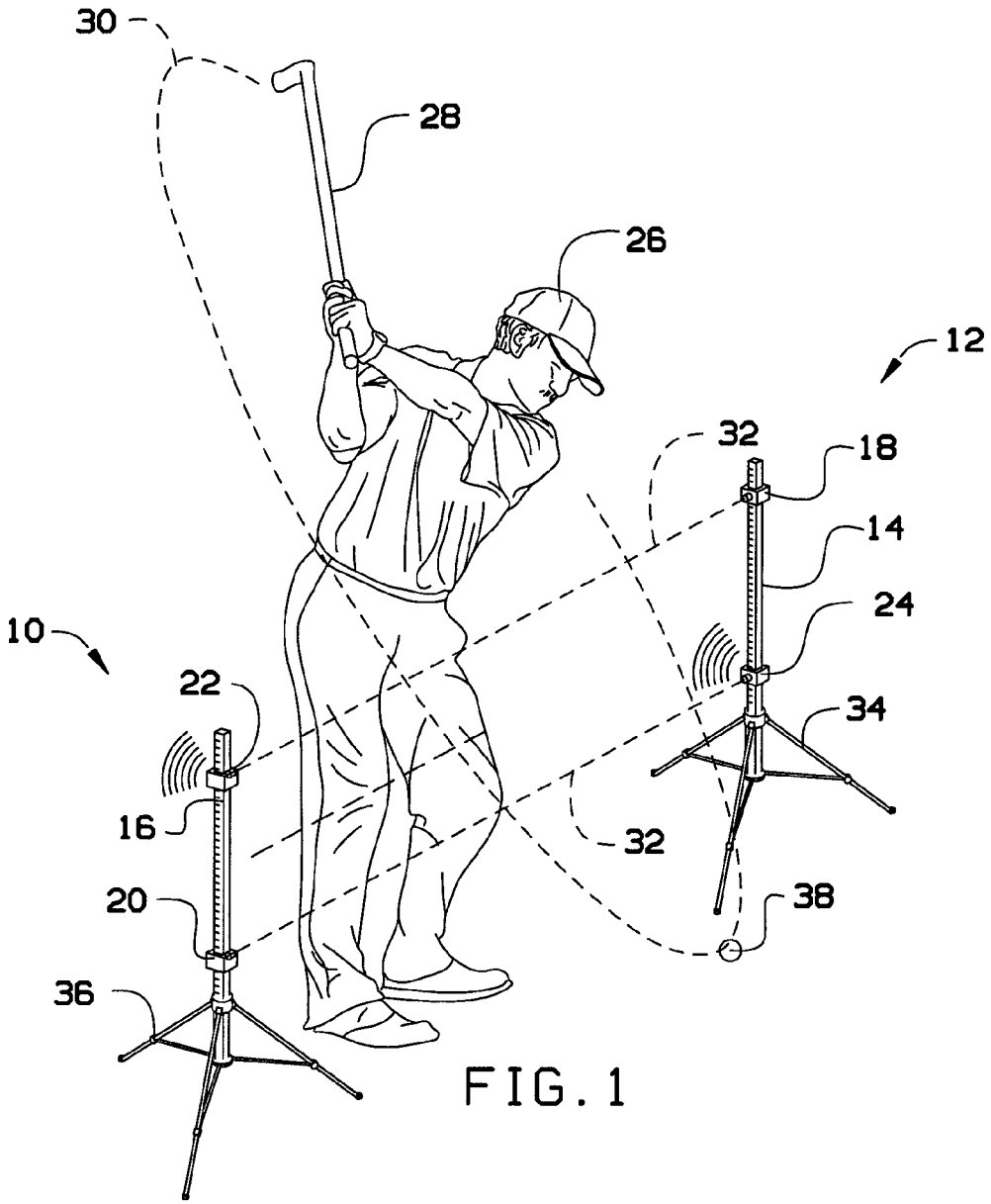
FIG. 1 is a perspective view of an embodiment of the invention shown in use.

By way of example, and referring to FIG. 1, user 26 swings golf club 28 in golf swing path 30 with either a proper golf swing path or a deviation from a proper golf swing path. User 26 is shown wearing pants with a known inseam. If user 26 does not have a known inseam then it can be calculated by measuring a leg from the underside of the crotch (known as the top inseam point) to the bottom side of the ankle (the lowest inseam point).

User 26 would like to improve the golf swing and a golf swing training device can accomplish this. The golf swing training device comprises rear stand 10 proximate front stand 12. Rear stand 10 comprises rear stand adjustment scale 16. Rear stand adjustment scale 16 contains a series of spaced measurements, much like a ruler, that measure distance upward from ground. Rear stand 10 is attached to upper light detector 22. Upper light detector 22 is communicatively coupled to an upper audible alarm. Rear stand 10 is attached to lower light source 20. Rear stand 10 is further attached to rear stand base 36 which can be expanded to provide stability to rear stand adjustment scale 16 and to ensure rear stand adjustment scale 16 is perpendicular to the ground.

The golf swing training device further comprises front stand 12. Front stand 12 comprises front stand adjustment scale 14. Front stand adjustment scale 14 contains a series of spaced measurements, much like a ruler, that measure distance upward from ground. Front stand 12 is attached to lower light detector 24. Lower light detector 24 is communicatively coupled to a lower audible alarm. Front stand 12 is attached to upper light source 18. Front stand 12 is further attached to front stand base 34 which can be expanded to provide stability to front stand adjustment scale 14 and to ensure front stand adjustment scale 14 is perpendicular to the ground.

This construction results in two light beams 32. Upper light beam 32 travels between upper light source 18 and upper light detector 22. Lower light beam 32 travels between lower light source 20 and lower light detector 24.

Figure 2:
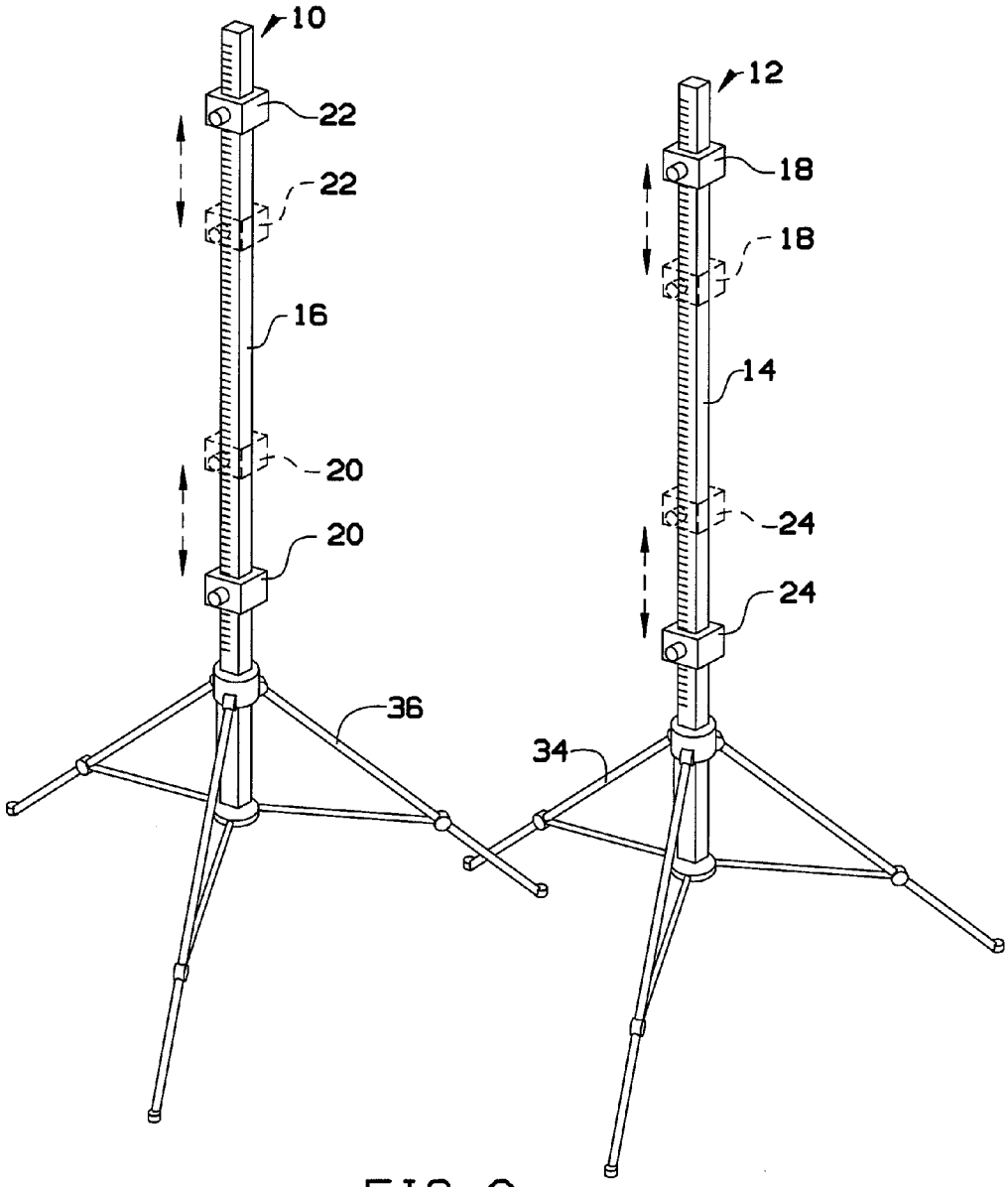
FIG. 2 is a perspective view of an embodiment of the invention.
Figure 4:
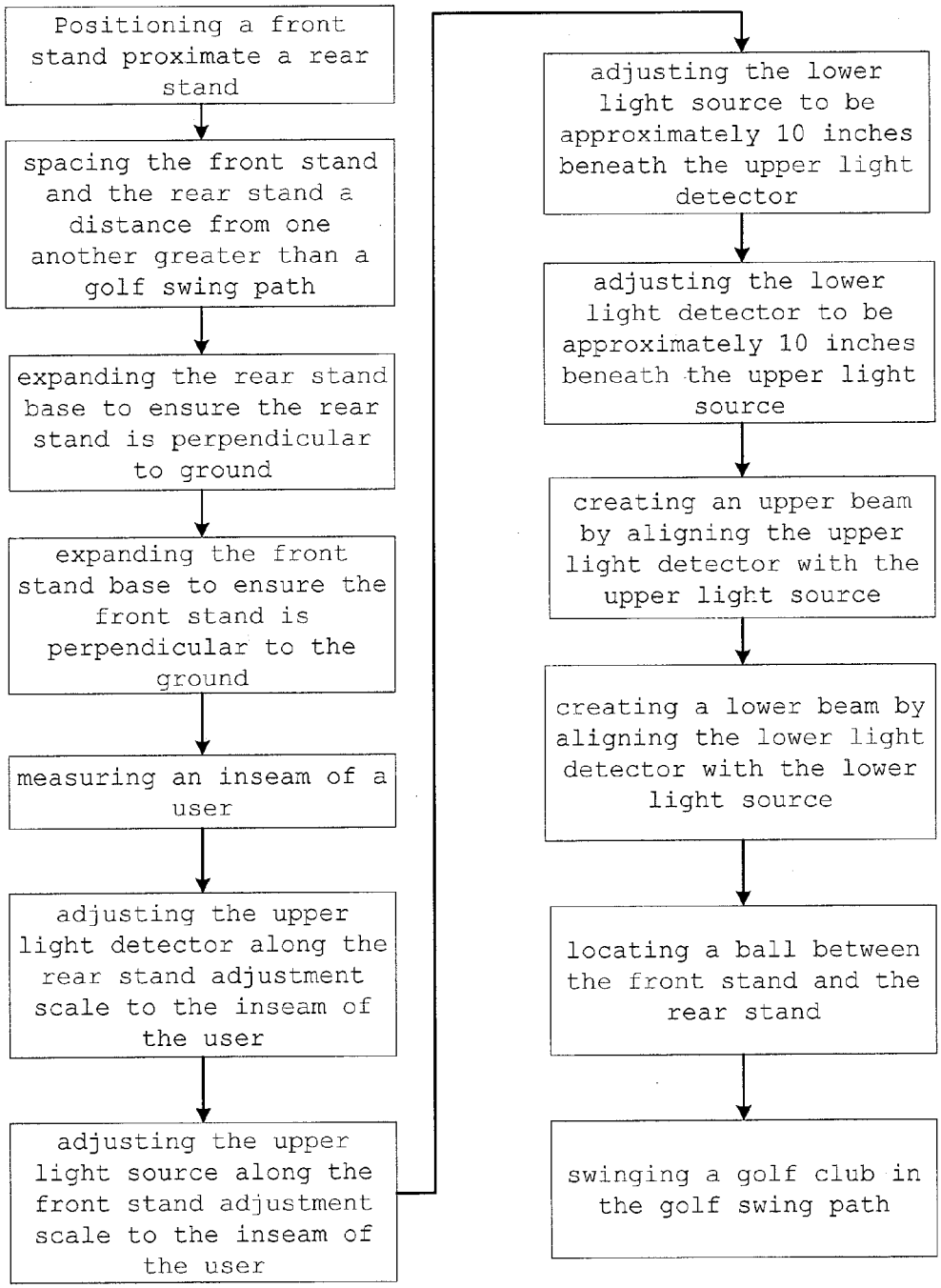
FIG. 4 is a schematic view of an embodiment of the invention.

FIG. 2 and FIG. 4 show a process for training a golf swing, the process comprises the following steps, not necessarily in order. First, positioning front stand 12 and rear stand 10 proximate one another. Then, spacing front stand 12 and rear stand 10 a distance from one another greater than golf swing path 30. Next, expanding rear stand base 36 ensuring rear stand 10 is perpendicular to the ground. Likewise, expanding front stand base 34 ensuring front stand 12 is perpendicular to the ground.

After this, measuring the inseam of user 26. Then, adjusting upper light detector 22 along rear stand adjustment scale 16 to the inseam of user 26. Next, adjusting upper light source 18 along front stand adjustment scale 14 to the inseam of user 26. Following that, adjusting lower light source 20 to be approximately 10 inches less than lower light detector 22. Then, adjusting lower light detector 24 to be approximately 10 inches beneath upper light source 18. After that, locating ball 38 between front stand 12 and rear stand 10. Then, swinging golf club 28 in golf swing path 30.

On the back swing, the proper golf swing path 30 is outside lower beam 32 and inside upper beam 32. On the down swing, the proper golf swing path 30 is inside upper beam 32 and outside lower beam 32. On the follow through, the proper golf swing path 30 is outside lower beam 32 and inside upper beam 32. Should the golfer deviate from the proper golf swing path, lower light detector 24 will produce a low tone and/or upper light detector 22 will produce a high tone.

Figure 3:
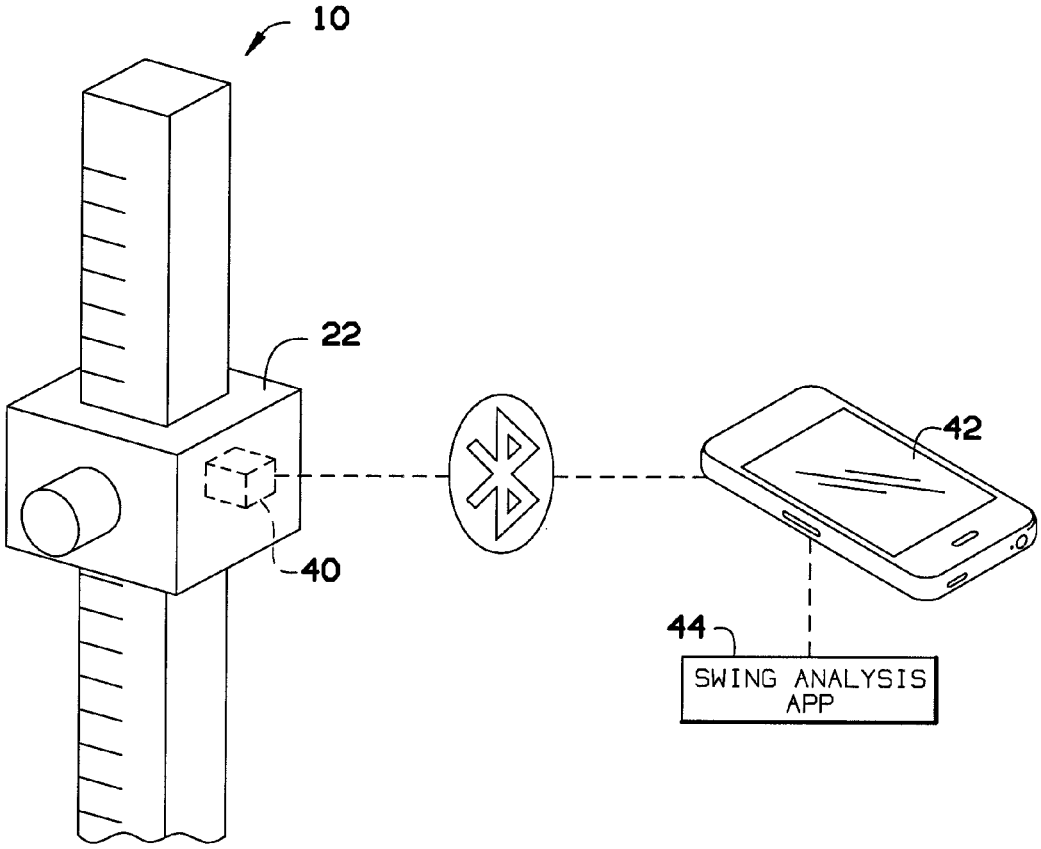
FIG. 3 is a schematic view of an embodiment of the invention.

As shown in FIG. 3, upper light detector 22 can be communicatively coupled to upper wireless transmitter 40. Likewise, lower light detector 24 can be communicatively coupled to lower wireless transmitter 40. Lower wireless transmitter 40 and upper wireless transmitter 40 are communicatively connected to Bluetooth receiver 42. Bluetooth receiver 42 is communicatively coupled to swing analysis application 44. In addition to low tone and high tone, proper golf swing paths and deviations from the proper golf swing path can be analyzed by swing analysis application 44.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A golf swing training device, configured to communicate deviation from a proper golf swing path; the golf swing training device comprising:

a rear stand further comprising a rear stand adjustment scale attached to an upper light detector, a lower light source and a rear stand base;

a front stand further comprising a front stand adjustment scale attached to a lower light detector, an upper light source and a front stand base;

an upper beam created by aligning the upper light detector with the upper light source;

a lower beam created by aligning the lower light detector with the lower light source;

wherein the proper golf swing path comprises swinging a golf club on a back swing outside the lower beam and inside the upper beam, on a down swing inside the upper beam and outside the lower beam and on the follow through, outside the lower beam and inside the upper beam;

wherein the deviation from the proper golf swing path is communicated to a user by an upper wireless transmitter communicatively coupled to the upper light detector and a lower wireless transmitter communicatively coupled to the lower light detector;

wherein the upper wireless transmitter and the lower wireless transmitter are communicatively coupled to a swing analysis application.

2. The golf swing training device of claim 1, wherein the rear stand adjustment scale and the front stand adjustment scale both contain a series of spaced measurements that measure distance upward from ground.

3. The golf swing training device of claim 1, wherein the deviation from the proper golf swing path is communicated by having the lower light detector produce a low tone and having the upper light detector will produce a high tone.

4. A process for using a golf swing training device in order to communicate a deviation from a proper golf swing path; the process comprising:

positioning a front stand proximate a rear stand wherein the front stand further comprises a front stand adjustment scale attached to a lower light detector, an upper light source and a front stand base;

wherein the rear stand further comprises a rear stand adjustment scale attached to an upper light detector, a lower light source and a rear stand base;

spacing the front stand and the rear stand a distance from one another greater than a golf swing path expanding the rear stand base to ensure the rear stand is perpendicular to ground;

expanding the front stand base to ensure the front stand is perpendicular to the ground;

measuring an inseam of a user adjusting the upper light detector along the rear stand adjustment scale to the inseam of the user;

adjusting the upper light source along the front stand adjustment scale to the inseam of the user;

adjusting the lower light source to be approximately 10 inches beneath the upper light detector;

adjusting the lower light detector to be approximately 10 inches beneath the upper light source creating an upper beam by aligning the upper light detector with the upper light source;

creating a lower beam by aligning the lower light detector with the lower light source;

locating a ball between the front stand and the rear stand;

swinging a golf club in the golf swing path; wherein the proper golf swing path involves swinging a golf club on a back swing outside the lower beam and inside the upper beam, on a down swing inside the upper beam and outside the lower beam and on the follow through, outside the lower beam and inside the upper beam; and communicating the deviation of the proper golf swing path.

5. The process of claim 4, wherein the rear stand adjustment scale and the front stand adjustment scale both contain a series of spaced measurements that measure the distance upward from the ground.

6. The process of claim 4, wherein the deviation from the proper golf swing path is communicated by having the lower light detector produce a low tone and having the upper light detector will produce a high tone.

7. The process of claim 4, wherein the deviation from the proper golf swing path is communicated by an upper wireless transmitter communicatively coupled to the upper light detector and a lower wireless transmitter communicatively coupled to the lower light detector; wherein the upper wireless transmitter and the lower wireless transmitter are communicatively coupled to a swing analysis application.

* * * * *